US008287305B2

(12) United States Patent
Sil

(10) Patent No.: US 8,287,305 B2
(45) Date of Patent: Oct. 16, 2012

(54) RECEPTACLE SYSTEM HAVING MULTIPLE WIRE QUICK CONNECTS

(76) Inventor: Greg D. Sil, Venetia, PA (US)

( * ) Notice: Subject to any disclaimer, the term of this patent is extended or adjusted under 35 U.S.C. 154(b) by 26 days.

(21) Appl. No.: 13/050,274

(22) Filed: Mar. 17, 2011

(65) Prior Publication Data

US 2012/0094511 A1 Apr. 19, 2012

Related U.S. Application Data

(60) Provisional application No. 61/394,055, filed on Oct. 18, 2010.

(51) Int. Cl.
*H01R 13/60* (2006.01)

(52) U.S. Cl. ..... 439/535

(58) Field of Classification Search ..... 439/528, 439/535, 107, 538, 76.1; 174/50, 53, 58
See application file for complete search history.

(56) References Cited

U.S. PATENT DOCUMENTS 3,716,651 A * 2/1973 Werner ..... 174/53
6,435,903 B1 * 8/2002 Nelson ..... 439/528
6,617,511 B2 * 9/2003 Schultz et al. ..... 174/53
6,945,815 B1 * 9/2005 Mullally ..... 439/535
7,034,222 B1 * 4/2006 York ..... 174/50
7,192,289 B2 * 3/2007 Kowalski ..... 439/106
7,569,771 B2 * 8/2009 Nicholson ..... 174/58
7,851,704 B2 * 12/2010 Fitch et al. ..... 174/53
2002/0185296 A1 * 12/2002 Schultz et al. ..... 174/53

* cited by examiner

*Primary Examiner* — Chandrika Prasad
(74) *Attorney, Agent, or Firm* — McKay & Associates, P.C.

(57) ABSTRACT

A "quick" receptacle system comprising a rough housing and duplex insert capable of being installed in minimal steps without multiple screws. Multiple top wire quick connects span a width of the rough housing attached to the rear, with each top wire quick connect further comprising a top stud hole defined therein open to the front and an interior means for conductively engaging wire conductors within the junction box. A conducting plate in contact with the interior means conductively connects each the top wire quick connects to a bottom-residing conductor point. Finally, a duplex insert having a duplex body is sized to be accommodated within the housing body of the rough housing multiple conducting studs projecting from a duplex rear of the duplex body, each conducting studs adapted to align and respectively seat within each the top stud hole of the rough housing.

12 Claims, 5 Drawing Sheets

RECEPTACLE SYSTEM HAVING MULTIPLE WIRE QUICK CONNECTS

CROSS-REFERENCE TO RELATED APPLICATIONS

The instant application claims benefit established by provisional application Ser. No. 61/394,055, filed Oct. 18, 2010, the disclosure of which is herein incorporated by reference.

BACKGROUND

The present invention relates generally to electrical circuit components, specifically receptacles and methods for installation. The instant apparatus and associated process will aid and reduce installation time for the electrician as well as safely simplify the final receptacle insert installation by electricians, maintenance personnel or even untrained individuals.

Known in the art is the utilization of "quick" receptacles which include screw-less housings to decrease electrician installation time. For instance U.S. Pat. No. 6,617,511 includes screw-less housing and cover plate which can be snapped into the housing. Further, U.S. Pat. No. 6,945,815 shows a quick release means of installing an electrical outlet using conductive studs. U.S. Pat. No. 7,569,771 shows an electrical outlet and junction box using vertically disposed prong fasteners to eliminate the use of screws within the junction box.

Some problems inherent in the prior art are that some products and systems are not up to code requirements. Furthermore, although the use of a snap-in receptacle eliminates the need for screws through the receptacle, the installation time at the rear of the receptacle within the junction box has never been addressed. A significant number of mechanical parts remain. There is a need then to provide a combination of electrical housings that ease installation and increase installation time even during the construction phase, from the outset of installation. Furthermore, the instant product can easily accommodate additional trades while safely concealing exposed wiring and has other advantages, as shown.

SUMMARY

A power distribution system, suitable for use in a building is provided, having a rough housing with a wiring junction device, a duplex insert and a cover plate. The rough housing is installed immediately after sheetrock installation and does not interfere with the finisher or painter. The second part, the duplex insert, is installed after all other trades are finished, whereby eliminating any scratches or over-sprays. Wiring from the building is connected to the rough housing via quick connects, and color coding facilitates correct wiring. The rough housing is connected to the electrical box with two screws provided. This part of the process can be completed directly after the sheetrock is installed. Power can be applied and the circuit and may be tested at this time. This housing also allows for testing without any exposed conductors. The duplex insert may be installed at any time via the snap fit connection. The cover plate may be integrally attached to the duplex insert.

Accordingly, what is provided is a "quick" receptacle system comprising a rough housing having a housing body, a front, two sides, and a housing rear and configured to seat within a junction box, the rough housing further comprising multiple top wire quick connects spanning a width of the rough housing attached to the rear, each top wire quick connect further comprising a top stud hole defined therein open to the front and an interior means for conductively engaging wire conductors within the junction box. Next, multiple conductor points attached are to the rear below the top wire quick connects, each conductor point in vertical alignment with a respective one of the top wire quick connects, and each conductor point including a bottom stud hole defined therein open to the front. A conducting plate in contact with the interior means conductively connects each the top wire quick connects to each conductor point. Finally, a duplex insert having a duplex body is sized to be accommodated within the housing body of the rough housing, the duplex insert further including multiple conducting studs projecting from a duplex rear of the duplex body, each conducting studs adapted to align and respectively seat within each the top stud hole or each the bottom stud hole to contact the conducting plate when the duplex insert is inserted and housed within the housing body. Because the duplex insert further includes a duplex receptacle with defined receptacle holes in conductive communication with the conducting studs for receiving a plug, a circuit is completed to be energized by the plug entering the duplex receptacle holes.

DETAILED DESCRIPTION OF THE PREFERRED EMBODIMENT

Figure 3:
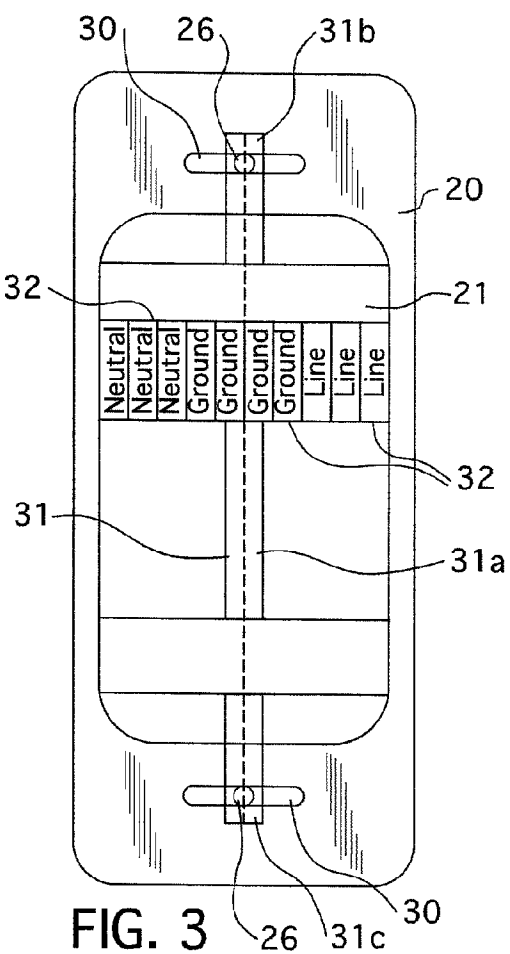
FIG. 3 shows a diagrammatic representation of the interior of the rough housing showing the grounding strap (grounding strap omitted from FIG. 2 structural view).
Figure 2:
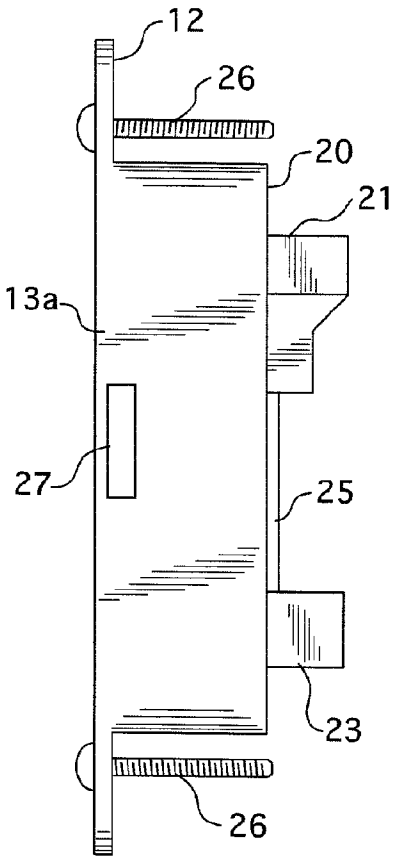
FIG. 2 shows a structural side elevation view of the rough housing.
Figure 1:
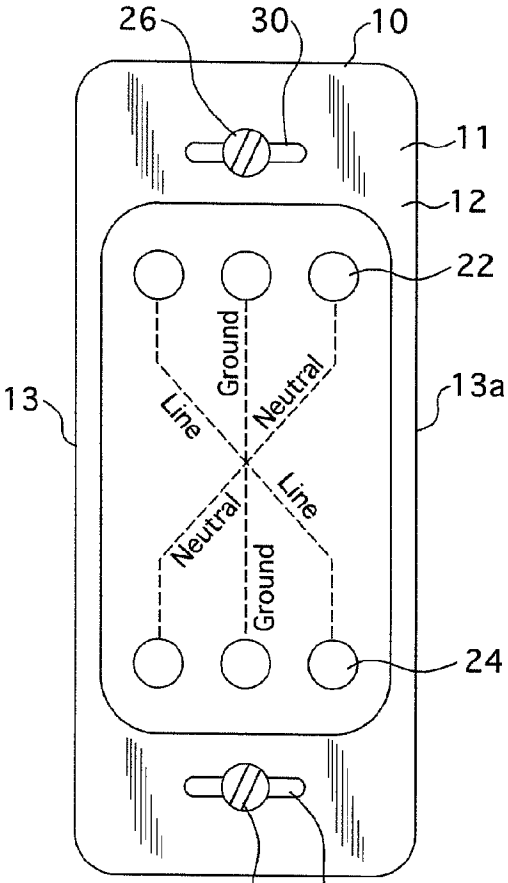
FIG. 1 shows a front elevation view and diagrammatic representation of the rough housing.
Figure 6:
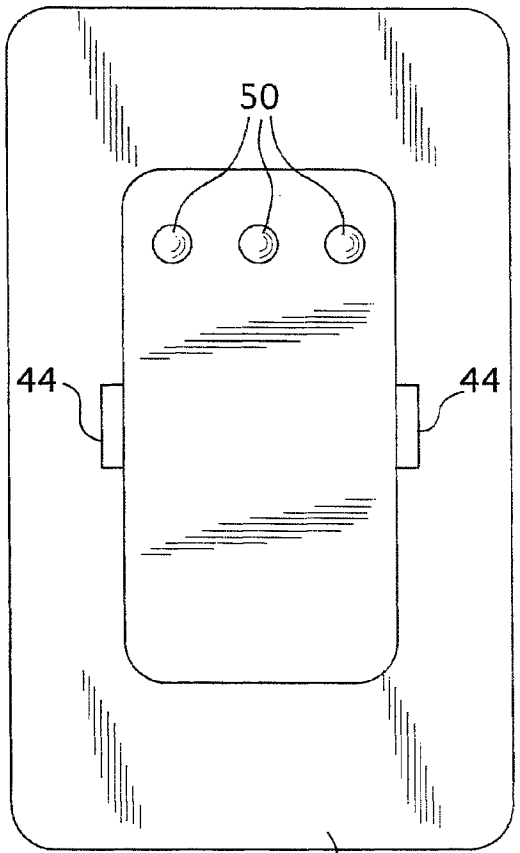
FIG. 6 shows a rear elevation vie of the cover plate with duplex insert therethrough.
Figure 5:
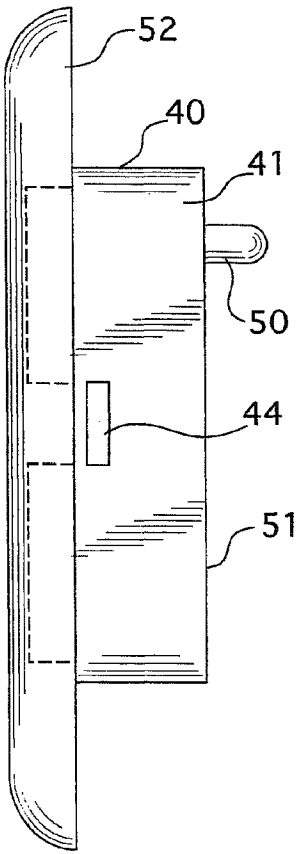
FIG. 5 shows a side elevation view of the duplex insert with cover plate installed.
Figure 4:
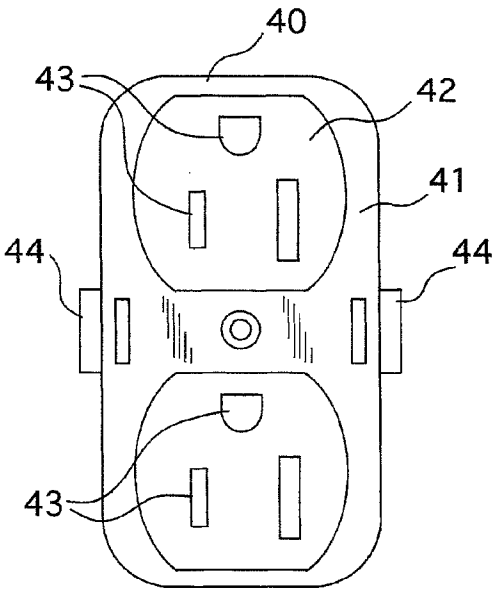
FIG. 4 shows a front elevation view of the duplex insert.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications and applications as would normally occur to persons skilled in the art to which the invention relates. This detailed description of this invention is not meant to limit the invention, but is meant to provide a detailed disclosure of the best mode of practicing the invention.

With reference to FIGS. 1-11, the instant system comprises two main subassemblies, a rough housing 10 and a duplex insert 40.

The first subassembly is the rough housing 10. Rough housing 10 is a generally rectangular box or housing having a housing body 11, a front 12, two sides 13, 13*a*, and a housing rear 20. Rough housing 10 is configured to seat within a junction box 70, or similar electrical connection container.

Rough housing 10 is attached to junction box 70 via screws 26. A pair of leveling slots 30 are defined through the front 12 of rough housing 10 for receiving screws 26, further aiding in maintaining the rough housing 10 in level fashion during installation. A snap-fit lock slot 27 is defined within each side 13, 13*a* of rough housing 10 to accept duplex insert 40, as further defined.

Attached to rear 20 of rough housing 10 are a set of multiple (more than one, preferably three) top wire quick connects 21. Top wire quick connects 21 span the width of said rough housing 10 attached to said rear 20, preferably molded between edges of the rough housing 10. Top wire quick connects 21 are configured similar to prior art wire-connectors in that each includes an interior means for conductively engaging wire conductors 71 within the junction box 70 by using a push-connection which pinches and holds the wire conductors ("interior means" therefore is the similar push-connection). The exception herein is that each said top wire quick connect 21 is critically different from prior quick connects in that the each quick-connect, rather than rear-end conducting holes relative to the location of the wire entry, each further comprises a top stud hole 22 defined therein open to the front 12 of rough housing 10. Therefore, the wire conductors 71 are received perpendicularly relative to the conductive point of contact between the conducting studs 50 (FIG. 5) and each top wire quick connect 21, and at the bottom of each top wire quick connect for further concealing the pinch-point. Top set wire quick connects 21 conductively engage the associated wire conductors 71 leading from sheathed power cable into junction box 70 by pinching the ends thereof, while maintaining the wire conductors 71 at the rear 20 of rough housing 10, in unexposed fashion. Top wire quick connects 21 are therefore both wire and stud connectors, color-coded with designations 32 by neutral, ground, and line. The designations 32 can be labeled or color-coded using labels, etching, double-sided tape or similar, and can be colored with or without the "neutral", "ground", and "line" verbage.

Next, multiple (more than one, preferably three) conductor points 23 are attached to the rear 20 of rough housing 10 below the top wire quick connects 21, each conductor point in vertical alignment with a respective one of the top wire quick connects 21. Each conductor point 23 includes a bottom stud hole 24 defined therein open to the front 12, similar to the configuration of each top stud hole 22 and preferably identical in size such that either the top stud holes 22 or the bottom stud holes 24 can receive studs 50 duplex insert 40, as further defined. The interior of each bottom stud hole 24 therefore is lined with a conductive material such as brass.

Prior to assembly, a thin plastic film (not shown) covers exposed top stud holes 24 and bottom stud holes 22, which can be peeled away during installation, prior to use, or which can be poked through.

A conducting plate 25 is in contact with the interior means of each top wire quick connect 21 and conductively connects each top wire quick connect 21 to the underlying bottom conductor point 23 to therefore maintain conductivity between the top wire quick connect 21 and the bottom conductor point 23. The conducting plate 25 can be a metal plate or conductive wire or similar conductive material. Wire conductors 71 accordingly need only engage top wire quick connects 21 to maintain the conduction path from bottom conductor point 23.

A grounding strap 31 is further attached to rough housing 10 traveling across its length. Grounding strap 31 is a vertically-disposed metal strap having a medial portion 31*a* and two strap ends 31*b*, 31*c* with one of the strap ends 31*b* fastened to one of the screws 26, and the other of the strap ends 31*c* fastened to the other of the screws 26, with the medial portion 31*a* in contact with the "ground" designation (designations 32). Medial portion 31*a* a can be in "contact" at any location through or behind the "ground" top wire quick connect as long as it is in conductive communication with the interior means of the quick connect. Therefore the grounding conducting path is continued from the junction box 70, to the screw 26, through the grounding strap 31, then to the designated top wire quick connect 21.

The other subassembly is the duplex insert 40. The duplex insert 40 includes a duplex body 41 sized to be accommodated within the housing body 11 of the rough housing 10. Duplex insert 40 further includes multiple (more than one, preferably three ducting studs 50 projecting from a duplex rear 51 of the duplex body 41. Each conducting stud 50 is preferably made of brass and is adapted to align and respectively seat within each top stud hole 22 or each bottom stud hole 24 to therefore contact the conducting plate 25 when the duplex insert 40 is inserted and housed within the housing body 11 of rough housing 10.

Duplex insert 40 further comprises a duplex receptacle 42 with defined receptacle holes 43 in conductive communication with the conducting studs 50 for receiving a plug, as a result completing a circuit to be energized by the plug entering the duplex receptacle holes 43 as is known in the art Critical here though is that the top wire quick connects 21 are arranged as a mirror image of the conductor points 23 across a forty-five degree axis (see FIG. 1 for instance) such that, without changing the position of the rough housing 10 once installed, the duplex insert 40 with conducting studs 50 can be used in ground-up fashion with the conducting studs 50 and therefore duplex receptacle 42 in an "up" position or inverted to ground-down use with the conducting studs 50 in a bottom position.

Duplex insert 40 engages rough housing 10, having duplex body 41 sized to be accommodated within housing body 11 of rough housing 10. Accommodation is made by the duplex insert 40 further including a pair of releasable snap-fits 44, each snap-fit 44 disposed on opposing sides of the duplex body 11. Because the rough housing 10 further includes a pair of snap-fit lock slots 27, each defined at one of the sides of the rough housing 10 adapted to receive each said snap-fit 44, the duplex insert 40 can be removably secured within the rough housing 10.

Cover plate 52 is of typical design, as a result rendering the appearance of the entire assembly as being a standard receptacle after installation is complete. Notably however is that the instant invention further comprises a removal tool 80 for manually removing the duplex insert 40 from the rough housing 10 (see FIGS. 8-10). The removal tool 80 has an inside surface 81 and outside surface 90 and further comprises multiple plastic prongs 82 projecting from the inside surface 81 configured to non-conductively engage the duplex receptacle holes 43 holes by friction. A pair of snap-fit releases 83 project from the inside surface 81 adapted to forcibly engage the snap fits 44 of the duplex insert 40. A handle 91 protrudes from the outside surface 90 for manipulation of the removal tool 80.

Figure 7:
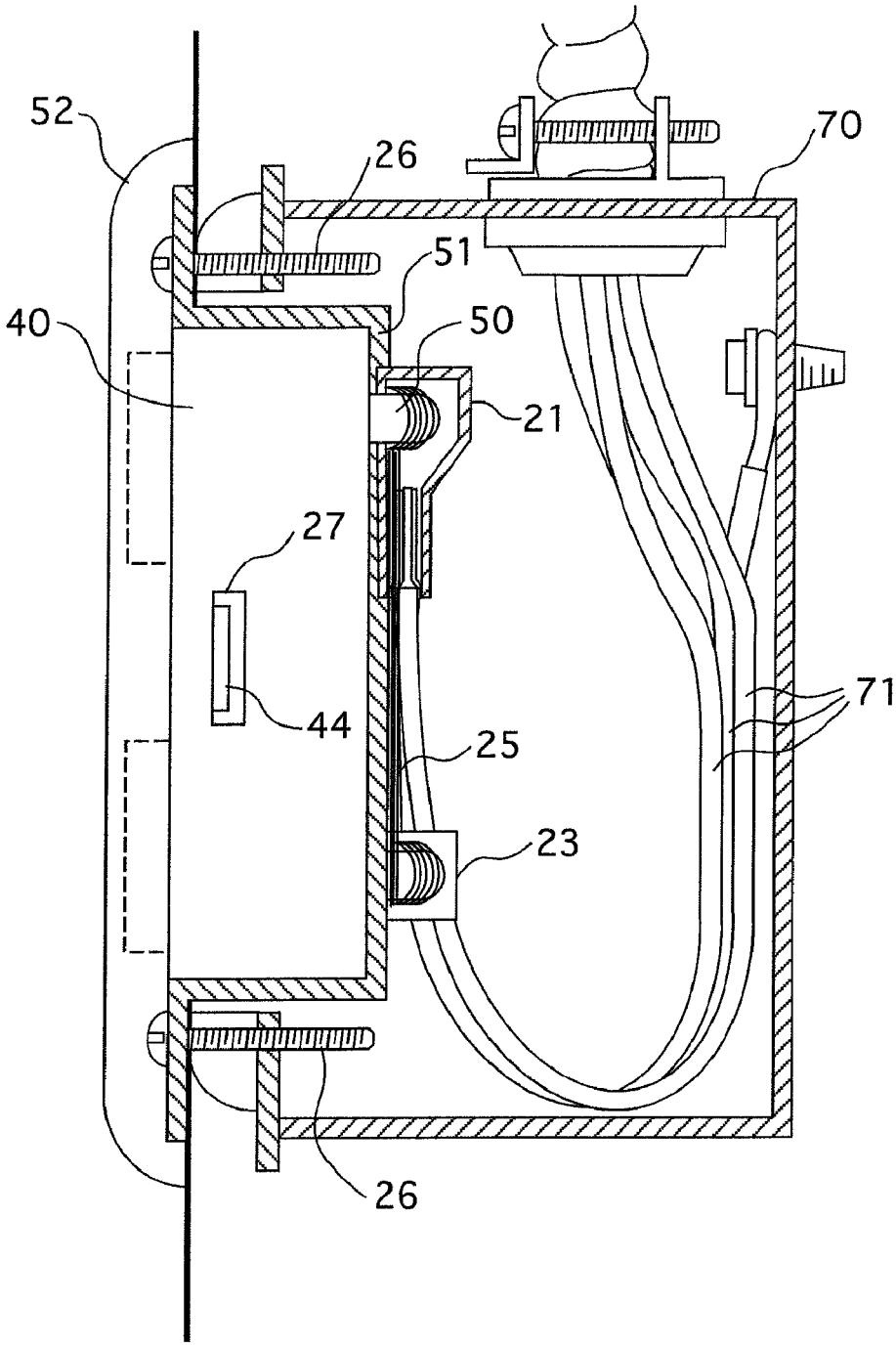
FIG. 7 shows a side view of the complete assembly as installed in ground-up manner a junction box.
Figure 10:
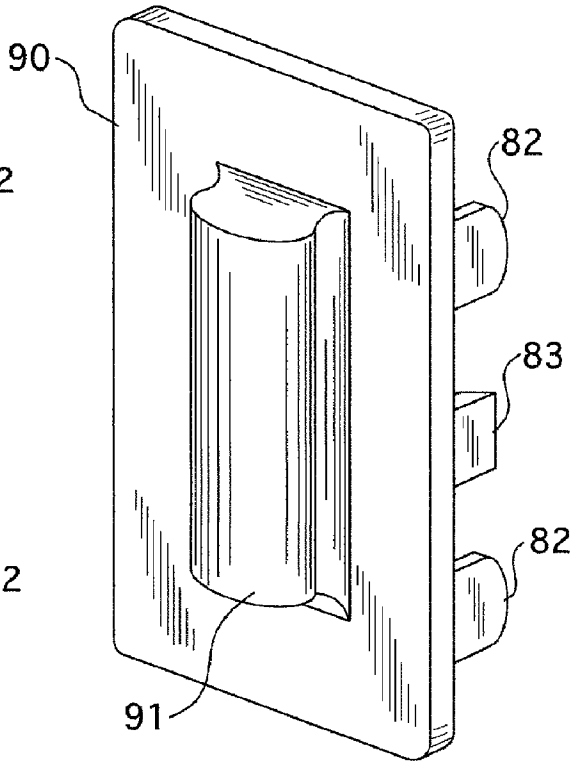
FIG. 10 shows a perspective view of the removal tool.
Figure 9:
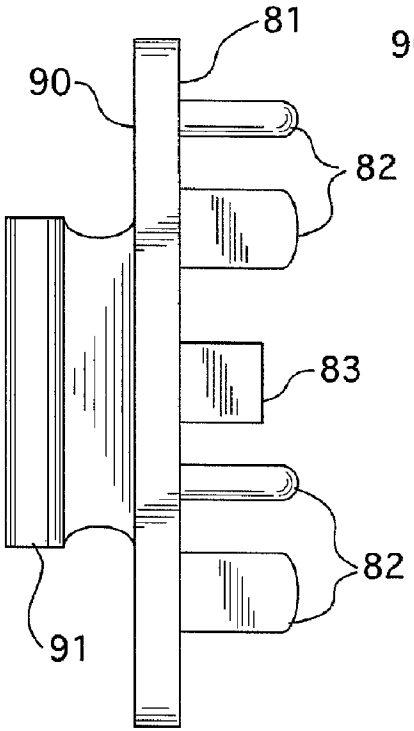
FIG. 9 shows a side vie of the removal tool.
Figure 8:
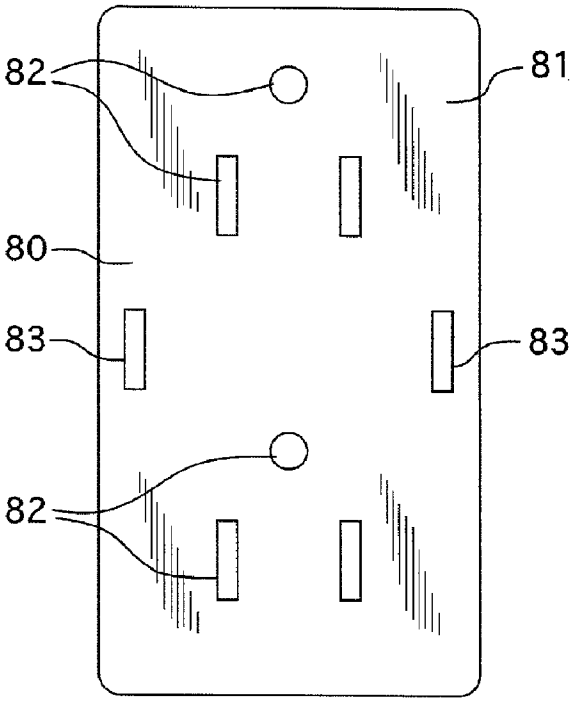
FIG. 8 shows a rear view of the removal tool for the duplex insert.
Figure 11:
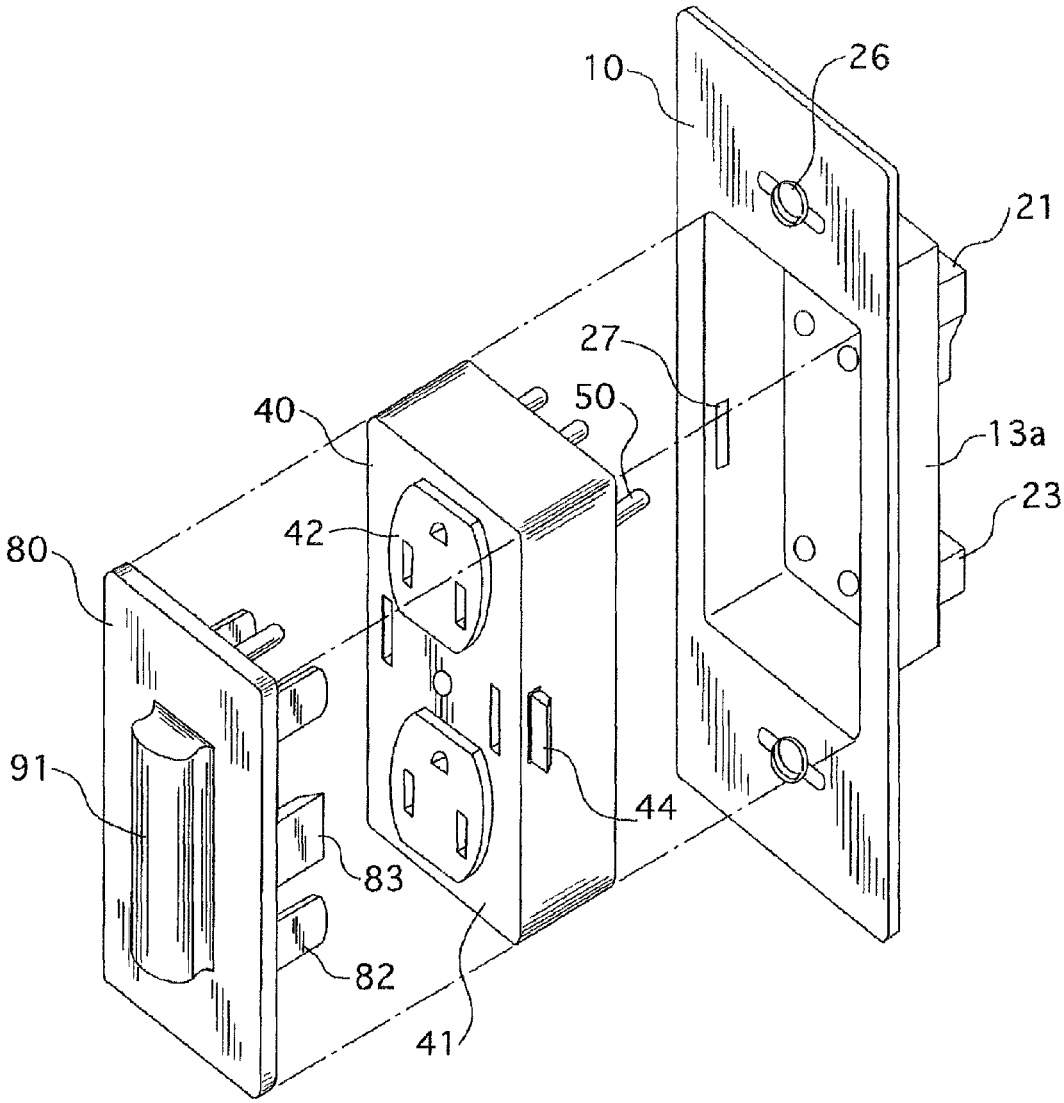
FIG. 11 shows an exploded view of the removal tool, duplex insert, and rough housing.

With reference to FIG. 7, for full installation and assembly the process comprises the steps of the following. An electrician installs branch circuit wires 70 into an electrical box 70 intended for the receptacle. At this stage sheetrock is applied to the walls by the carpenter. The wires are stripped of ¾" of their insulation. Common wires 70 are placed into the quick connects 21 according to the color coded slots. The rough housing 10 (FIG. 1) is screwed into the opening with two screws 26. The rough housing 10 mated connections 50 for the duplex insert 40 can be filled with an anti-oxidant and covered with a protective film to prevent accidental painting. The circuit can be energized and tested at this time. Final wall finishing and painting by other trades may also occur at this time. The duplex insert 40 is snapped into the rough housing 10 and has the cover 52 already attached. To remove the duplex insert 40, simply insert the removal tool (FIGS. 8-10) or use a straight blade screwdriver into the release slots.

As a result, by using the rough housing as compared to a standard receptacle, the plastic shell does not conduct electricity and therefore no shorts could occur during installation or removal. Installation can occur earlier in the construction phase. Furthermore, other trades can be easily accommodated, exposed wiring is totally concealed, and no twist-on wire connectors are required nor is splicing necessary. By using the duplex insert, faster installation time is realized, the receptacle can be replaced without a certified electrician safely and without any wiring changes (in less than a minute), the receptacle can be replaced without de-energizing the circuit, no accidental shorts can occur, and there are no mechanical parts such as screws in the receptacle.

I claim:

1. A receptacle system, comprising:

a rough housing having a housing body, a front, two sides, and a housing rear and configured to seat within a junction box, said rough housing further comprising:

multiple top wire quick connects spanning a width of said rough housing attached to said rear, each said top wire quick connect further comprising a top stud hole defined therein open to said front and an interior means for conductively engaging wire conductors within said junction box;

multiple conductor points attached to said rear below said top wire quick connects, each said conductor point in vertical alignment with a respective one of said top wire quick connects, and each said conductor point including a bottom stud hole defined therein open to said front;

a conducting plate in contact with said interior means and conductively connecting each said top wire quick connects to each said conductor point; and, a duplex insert having a duplex body sized to be accommodated said housing body of said rough housing, said duplex insert further including multiple conducting studs projecting from a duplex rear of said duplex body, each said conducting studs adapted to align and respectively seat within each said top stud hole or each said bottom stud hole to contact said conducting plate when said duplex insert is inserted and housed within said housing body, said duplex insert further comprising a duplex receptacle with defined receptacle holes in conductive communication with said conducting studs for receiving a plug, as a result completing a circuit to be energized by said plug entering said duplex receptacle holes.

2. The receptacle system of claim 1, further comprising said top wire quick connects being color coded for designations including a neutral, ground, and line, and wherein said rough housing includes a pair of leveling slots, each said leveling slot defined within said front of said rough housing at a top and bottom thereof for receiving a screw.

3. The receptacle system of claim 2 further comprising a vertically-disposed grounding strap having a medial portion and two strap ends with one of said strap ends fastened to one of said screws, the other of said ends fastened to the other of said screws, with said medial portion in contact with said ground.

4. The receptacle system of claim 3, wherein said sere is in contact with a junction box.

5. The receptacle system of claim 1, wherein said duplex insert further comprises a pair of releasable snap-fits, each said snap-fit disposed on opposing sides of said duplex body.

6. The receptacle system of claim 5 wherein said rough housing further includes a pair of snap-fit lock slots, each said lock slot defined at one of said sides of said rough housing adapted to receive each said snap-fit such that said duplex insert can be removably secured within said rough housing.

7. The receptacle system of claim 1, further comprising a thin plastic film on said front of said rough housing covering said top stud holes and said bottom stud holes.

8. The receptacle system of claim 1, wherein said top wire quick connects are arranged as a minor image of said conductor points across a forty-five degree axis such that, without changing the position of said rough housing, said duplex insert with said conducting studs can be used in ground-up fashion with said conducting studs in an up position or inverted to ground-down with said conducting studs in bottom position.

9. The receptacle system of claim 1, further comprising a removal tool for manually removing said duplex insert from said rough housing.

10. The receptacle system of claim 9, wherein said removal tool has an inside surface and outside surface and further comprises multiple plastic prongs projecting from said inside surface configured to non-conductively engage said duplex holes by friction.

11. The receptacle system of claim 10, further comprising a pair of snap-fit releases projecting from said inside surface adapted to forcibly engage the snap fits of said duplex insert.

12. The receptacle system of claim 10, further comprising a handle protruding from said outside surface for manipulation of said removal tool.

* * * * *